US005855369A

United States Patent [19]

Lieberman

[11] Patent Number: 5,855,369

[45] Date of Patent: Jan. 5, 1999

[54] EQUIPMENT FOR AND METHODS OF CONDUCTING A PRIZE DRAWING GAME OF CHANCE

[76] Inventor: Lee Lieberman, 22337 Morea Way, Woodland Hills, Calif. 91367

[21] Appl. No.: 938,683

[22] Filed: Sep. 26, 1997

Related U.S. Application Data

[62] Division of Ser. No. 553,787, Oct. 23, 1995, abandoned, which is a continuation of Ser. No. 112,857, Aug. 27, 1993, abandoned.

[51] Int. Cl.[6] ..... A63F 3/06

[52] U.S. Cl. ..... 273/139; 273/269

[58] Field of Search ..... 273/138.1, 139, 273/269, 270

[56] References Cited

U.S. PATENT DOCUMENTS

| | | | |
|---|---|---|---|
| 2,355,785 | 3/1944 | Dorfman | 273/269 X |
| 4,317,949 | 3/1982 | Bachman et al. | 273/139 |
| 4,373,726 | 2/1983 | Churchill et al. | 273/139 X |
| 4,398,708 | 8/1983 | Goldman et al. | 273/139 X |
| 4,536,707 | 8/1985 | McNeight et al. | 273/139 X |
| 4,671,512 | 6/1987 | Bachman | 273/139 |
| 4,677,553 | 6/1987 | Roberts et al. | 273/269 X |
| 4,711,454 | 12/1987 | Small | 273/269 |
| 4,764,666 | 8/1988 | Bergerson | 273/139 X |
| 4,832,341 | 5/1989 | Muller et al. | 273/139 |
| 4,833,307 | 5/1989 | Gonzalez-Justig | 273/139 X |
| 4,953,895 | 9/1990 | Goussios | 273/139 X |
| 5,002,313 | 3/1991 | Salvatore | 273/139 X |
| 5,080,364 | 1/1992 | Seidman | 273/139 X |
| 5,125,689 | 6/1992 | Heninger | 273/139 X |

FOREIGN PATENT DOCUMENTS

| | | | |
|---|---|---|---|
| 0431252 | 6/1991 | European Pat. Off. | 273/269 |
| 0459007 | 12/1991 | European Pat. Off. | 273/269 |
| 2660207 | 10/1991 | France | 273/269 |
| 2217614 | 11/1989 | United Kingdom | 273/269 |

*Primary Examiner*—William E. Stoll
*Attorney, Agent, or Firm*—Lyon & Lyon LLP

[57] ABSTRACT

Equipment and methods for entering and conducting a prize drawing game of chance are disclosed, some of which do not require the participant to make a purchase or pay anything of value in order to enter. Entry forms are provided which depict and advertise the product which the game promotes, and which include spaces for the entrant to write self-identifying information. The entry forms also include a laser-scannable bar code which uniquely identifies the product being promoted. The inclusion of this bar code facilitates automated sorting of entry forms and makes practical the processing of a plurality of games, each promoting a different product, simultaneously within a single, centralized processing facility. The entry form also includes spaces in which the entrant is required to write the universal product code number which uniquely identifies the product being promoted. Since this number is not disclosed on the printed entry form, and since the most convenient source of the number is the label of the product that is being promoted, the handwritten-UPC-number requirement gives consumers an incentive to seek out, view and handle the product which is the subject of the promotion.

4 Claims, 2 Drawing Sheets

EQUIPMENT FOR AND METHODS OF CONDUCTING A PRIZE DRAWING GAME OF CHANCE

This is a divisional of application Ser. No. 08/553,787 filed on Oct. 23, 1995, now abandoned; which is a continuation of application Ser. No. 08/112,857 filed on Aug. 27, 1993, now abandoned.

BACKGROUND OF THE INVENTION

The field of the present invention is prize drawing games of chance, equipment therefor, and methods of entering, playing, and administering such games.

Games of chance, and prize drawings in particular, are well known in the art. However, prize drawings typically require the entrant to purchase, directly or indirectly, a chance to win the offered prize. For example, theaters use patrons' numbered ticket stubs as entry forms in prize drawings; but the theater patron is required, at least indirectly and incidentally, to pay money for a chance to win the drawing, since the patron has an opportunity to participate in such a drawing only because he has purchased a theater ticket bearing a numbered stub. The theater's objective in sponsoring such a drawing, typically, is to entertain patrons and give them added incentives to attend the theater. More generally, "door prize" drawings typically are conducted at events that require purchase of a ticket for admission; and the stub of the purchased ticket itself is typically the thing that is deposited, and later randomly drawn, to identify the game winner. Again, the game sponsor's objective typically is to entertain the patrons attending the event and to furnish an added incentive to attend.

In another widely-used form of prize drawing game of chance, the raffle, each game entrant is required to buy at least one raffle ticket. The raffle sponsor typically advertises one or more prizes as an inducement to the public to buy raffle tickets. A typical raffle ticket is separable into two parts, a receipt which the entrant retains and a stub which he deposits in a container for possible selection in a subsequent random drawing. The two parts of the raffle ticket typically bear matching numbers, and the stub which is deposited for the drawing often includes spaces for written information, typically filled out by the entrant, which further identifies him and provides information to facilitate notification should he win the drawing. Selection of a particular entrant's stub in the random drawing identifies that entrant as a prize winner. A raffle sponsor's objective, typically, is to raise money for some organization or cause. The sponsor typically attempts to accomplish this objective by selling enough tickets, at a high enough price, to fund the purchase of the prize or prizes, defray the costs of administering the game, and still have money left over.

Also known in the art are prize drawing games of chance designed to promote sales of a particular product. Typically in these games, the entrant is required to purchase the product, and deposit proof that he has done so, in order to be eligible for a random prize drawing. Such games are typically sponsored by manufacturers and/or marketers of the product in question, with the objective of generating advertising for that product which is of sufficient value to more than offset the costs of funding prizes and administering the game.

"Purchase-required-for-entry" games of chance can be difficult to administer because they are legally problematical in some jurisdictions, where anti-lottery laws prohibit or heavily regulate prize drawing games of chance in which something must be purchased, or in which something of value must otherwise be given by the entrant, in order to have a chance at winning the prize. Hence, the administration of a "purchase-required-for-entry" game of chance may be cumbersome, expensive or even impractical altogether, especially on an interstate scale, due to difficulties in compliance with local variations in the law. Typically, however, legal objections to a prize drawing game of chance may be overcome by providing means to enter the drawing which do not require the entrant, directly or indirectly, to make a purchase or otherwise part with anything of value in return for a chance at winning the prize.

Numerous means are known by which to disseminate written advertising and promotional materials. Handbills, flyers and tear-off posters are among such means, as are product redemption coupons distributed by mail or through newspaper inserts. In addition, cash registers have long been in use which generate paper tapes or tickets (see, e.g., Yantis, U.S. Pat. No. 1,011,549); and these tapes or tickets may be imprinted with advertising messages which promote the sale of a product. Redemption coupons (but not prize drawing game of chance entry forms) imprinted on the backs of cash register tapes are in widespread use. More recently, automatic teller machines (ATM's) have come into use which eject written transaction receipts on which promotional messages and game-entry forms may be imprinted. See, e.g., Bachman et al., U.S. Pat. Nos. 4,671,512 and 4,817,949, which disclose the use of ATM receipts as the medium for a game of chance (but not a prize drawing game of chance) designed to promote use of the ATM machine by bank customers (but not to induce the game entrant to acquaint himself with an item of merchandise).

Also known, and by now in virtually universal use in merchandising in the United States, is the printing of laser-scannable bar codes upon the labels of consumer products. Computerized cash registers at retail-store checkout stations read and decipher the bar codes by means of laser scanners. The products being purchased are thereby identified and priced by the computer, which generates and prints out a receipt tape that itemizes the products purchased and reflects information, including prices, taxes, and totals. If bar-coded redemption coupons are presented by the customer at the checkout station, they too are laser-scanned; and the computer thereby identifies the products to which the coupons pertain, calculates the pertinent discount, adjusts the transaction accordingly, and reports the adjustment on the receipt tape.

Typically accompanying the laser-scannable bar code on a product label is a numeric code (known as the Universal Product Code, and widely referred to as the "UPC"). Typically printed along the margin of the bar code, the UPC includes a 5-digit series of numerals which constitutes a manufacturer identification number, followed by a second 5-digit series of numerals which constitutes an item code. The manufacturer-identifying portion of the UPC is assigned, registered and centrally administered by the Uniform Code Council, Inc., 8163 Old Yankee Road, Suite J, Dayton, Ohio 45459. The Council prescribes guidelines for use of the UPC to improve its usefulness to member companies. Each manufacturer controls the 5-digit item codes which it assigns to its own products. The UPC code placed on an item of merchandise thus uniquely identifies that item by product description—e.g., a 6.125 ounce can of STARKIST brand white tuna packed in water—and by the manufacturer which makes or purveys the product.

If for any reason the laser scanner at the retail store checkout station fails to read the bar code, the operator of the checkout station can input the UPC number manually, which gives the computer information similar to what the bar code would give it if the bar code were read, and enables the computer to generate accurate descriptive and pricing information for the product in question and to print, automatically, a receipt tape reflecting that information.

Although the use of computer-scannable bar codes and numeric universal product codes (UPCs) for inventory control and automated checkout is widespread, the employment of such bar codes and numeric UPCs as aids in the operation and administration of a product-promotional prize drawing game of chance, in the manner disclosed hereinafter, is a new use.

SUMMARY OF THE INVENTION

The present invention relates to equipment and methods specially adapted to those prize drawing games of chance aimed at promoting a particular product or item of merchandise. According to the present invention, prize drawing game of chance entry forms are prepared which are imprinted with a laser-scannable bar code that uniquely identifies the particular product to be promoted. The entry forms are distributed to potential customers for that product, who are invited to complete the entry forms by writing self-identifying information thereon and to deposit the entry forms for collection for a subsequent random prize drawing. The drawing, and the product being promoted, may be advertised on the entry forms themselves and/or by other means. The rules of the drawing may also be printed on the entry forms and/or elsewhere.

In accordance with the present invention, a plurality of prize drawing games of chance, each promoting a different product, may be conducted simultaneously and may be administered simultaneously through a single, centralized processing facility. Once the completed entry forms are deposited and collected, the bar codes they bear are laser-scanned and the entry forms thereby sorted into separate batches, each separate batch containing the entry forms that pertain to the game that pertains to each different product being simultaneously promoted. The sorting process may be fully automated, or may be semi-automated—i.e., conducted by a human sorter with the laser-scanning device serving as an aid in rapidly identifying the particular product (and therefore the particular game) to which a particular entry form relates.

After the entry forms are sorted into separate batches pertaining to separate products and games, the winner of each separate game is identified by a separate random drawing from each separate batch.

The entry forms, in addition to being imprinted with the bar code that uniquely identifies the product being promoted, may be imprinted with a series of boxes, lines, blanks, or like indicia adapted to indicate a place for affixing, in handwritten form, the sequence of numerals constituting the universal product code (UPC) number which corresponds to that product, and the entrant may be instructed that the UPC numerals must be written in the indicated spaces in order for the entry form to be deemed complete and eligible for the prize drawing. Since the most readily available source of these numerals (from the standpoint of the typical consumer) is the label of the product being promoted, the inclusion of a requirement that the UPC number be filled in on the prize drawing entry form tends to create an incentive for the entrant to seek out, view, and handle (if not actually purchase) the product being promoted.

In another embodiment, the entry form is imprinted with a mock bar code which, although it is not laser-scannable, simulates the appearance of a true, laser-scannable bar code and thus aids the entrant in finding and recognizing the bar code, and the UPC number, on the label of the product being promoted, thereby facilitating for the entrant the task of filling in the UPC numerals correctly on the entry form. Although the use of a mock bar code (as opposed to a true, laser-scannable bar code) lacks the advantage of fully-automated sortability, it does preserve the other advantages of the invention, and the entry forms can be sorted by the handwritten UPC number, if desired.

The present invention provides for the availability to the entrant of several alternative means of procuring entry forms, at least some of which means do not require, directly or indirectly, that the entrant make a purchase or give anything of value in return for a chance to win the game. Entry forms for the same game, involving the same product, may for example be distributed simultaneously on the backs of ATM machine receipts, on the backs of cash register receipt tapes, in the mail, in the form of tear-out coupons distributed in newspapers or advertising flyers, in the form of tear-off coupons on posters, or in the form of clippable coupons on shopping bags. The entrant may also be offered the opportunity to enter the drawing by means of a "home-made" entry form, such as a 3-by-5-inch index card with the product's bar code, taken from the product's actual label, affixed to it together with information identifying the entrant.

The sponsor or operator of the product-promotional game of chance, by selecting from among these alternative means of entering the game, may target entrants from groups which have higher-than-average likelihoods of becoming actual purchasers of the product being promoted. For example, a leather checkbook cover might be more effectively promoted via game entry forms on the backs of ATM receipts than by game entry forms on the backs of grocery-store cash register tapes; whereas a game of chance aimed at promoting a grocery-store item may more effectively target likely buyers if entry forms are printed on the backs of grocery store cash register tapes, or presented as tear-off coupons on posters displayed in grocery stores. The requirement that the entrant fill in the UPC number acts as a further means of targeting likely purchasers as it tends to require a game entrant actively to seek out and examine the product in order to ascertain the UPC number.

It is thus an object of the present invention to provide equipment and methods by which a well-targeted product-promotional prize drawing game of chance may be simply, efficiently and economically conducted.

It is a further object of the present invention to provide a novel sorting means which renders the administration of a product-promotional prize drawing game of chance more economical, and which renders it practical to conduct a plurality of such games, each involving a separate product, simultaneously, and to administer those games efficiently through a single, centralized processing facility.

The present invention has as a further object to provide means of access to a wide variety of advertising outlets, while avoiding possible legal complications due to variations in local law regarding games of chance, by providing a variety of alternative means to obtain an entry form for a product-promotional prize drawing game of chance, at least some of which means do not require, directly or indirectly, that the entrant make a purchase or part with value in order to be eligible for the prize.

Yet another object of the present invention is to provide a novel use for the laser-scannable bar codes on products— namely, their use as a cheap and efficient sorting means in product-promotional prize drawing games of chance.

Still another object of the present invention is to provide a novel use for the numeric universal product codes appearing on products for sale—namely, their use as an inducement to a prize-drawing game of chance entrant to seek out, view, and handle the product to which the UPC number relates, and to use the UPC number as a means to verify (to some level of probability) that the entrant has so acquainted himself with the product.

Other and further objects and advantages of the invention will appear hereinafter.

BRIEF DESCRIPTION OF THE DRAWINGS

FIG. 4 also shows an advertisement depicting the product which corresponds to that UPC number.

DETAILED DESCRIPTION OF THE PREFERRED EMBODIMENTS

Figure 1:
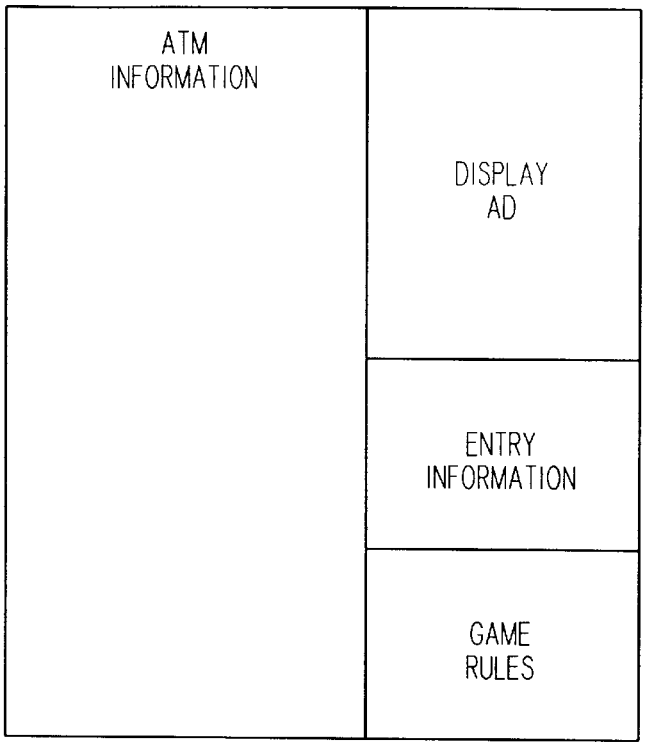
FIG. 1 is a schematic view of the front side of an ATM receipt bearing on its right portion an indication of a location for matter constituting a prize drawing game of chance entry form including an advertisement depicting a product, a statement of game rules, and spaces in which the entrant is to enter self-identifying information and on its left portion conventional data recording a completed ATM transaction.
Figure 2:
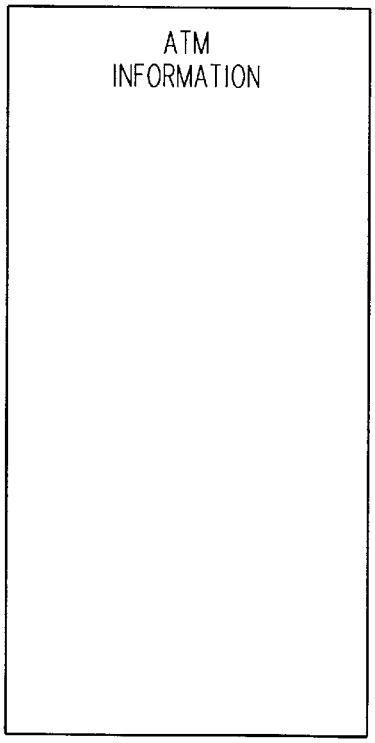
FIG. 2 is a schematic view of the front side of an ATM receipt, bearing an indication of a location for conventional data recording an ATM transaction.
Figure 3:
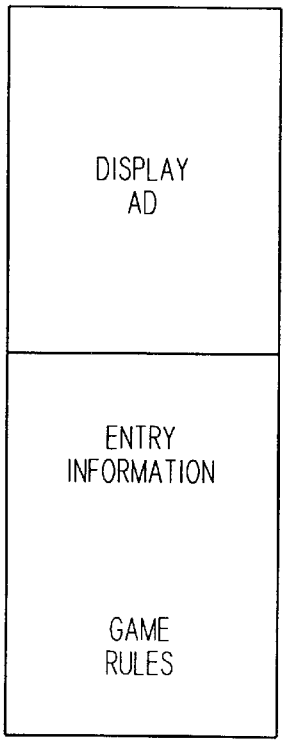
FIG. 3 is a schematic view of the back side of an ATM receipt bearing an indication of a location for a prize drawing game of chance entry form, including an advertisement depicting a product, a statement of game rules, and spaces in which the entrant is to enter self-identifying information.

According to the present invention, written entry forms may be made available to potential participants in one or more of numerous different, alternative ways, including, for example, the following: (1) As clippable coupons distributed in newspapers, mailers, flyers, or the like; (2) as tearable coupons mounted on or in a conventional poster, card dispenser, coupon dispenser, or the like; (3) as part of an automated teller machine (ATM) receipt, as illustrated in FIGS. 1–3, which receipt the potential participant may obtain as a result of using an ATM machine, or being given the receipt by or through someone else who has used the ATM machine, or by being given an ATM machine form apart from an ATM transaction, which form would typically be blank except for the matter which comprises the prize drawing game of chance entry form; (4) as part of a cash register receipt tape, which could be obtained by the potential participant in the course of the sales transaction at a store, or by or through another person who has participated in such a transaction, or as a length of cash register tape which has not been imprinted with transaction receipt date but has been imprinted with prize drawing game of chance entry form matter; (5) as a form imprinted on regular card stock and handed out by or through a participating establishment; or (6) as coupons imprinted upon shopping bags.

It will be appreciated that not all methods of entering the prize drawing game of chance require the entrant to have utilized an ATM machine, or to have made a purchase at a cash register; and entrants enjoy the option to select a method of entering the prize drawing which does not require them to give anything of value in order to be admitted to participation in the drawing.

Figure 5:
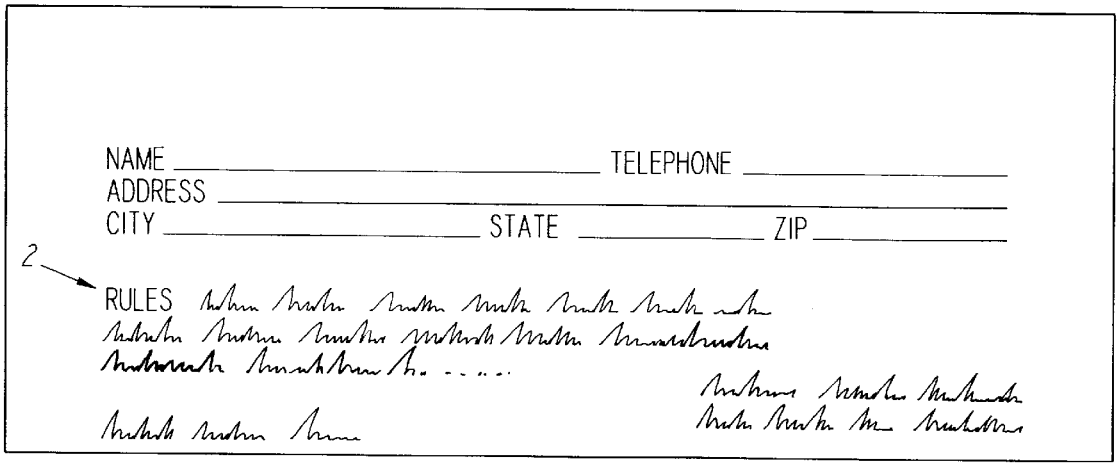
FIG. 5 is a pictorial view of the back side of a prize drawing game of chance entry form, bearing spaces for an entrant to fill in self-identifying information and, in phantom, a statement of game rules.

The entry form (FIGS. 1, 3 and 5) provides spaces for participants to indicate appropriate self-identifying information (for example, name, address and telephone number).

Figure 4:
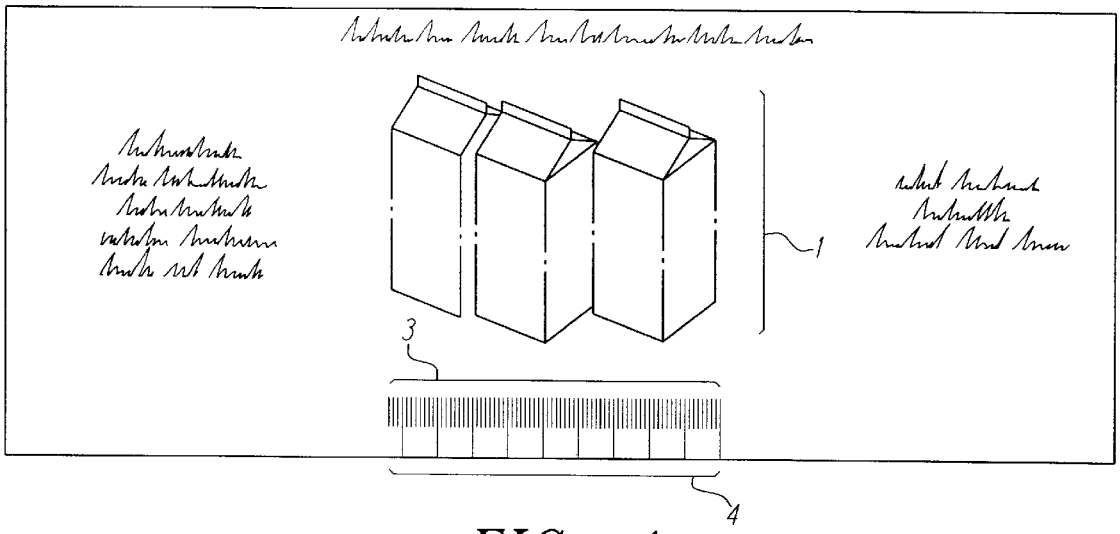
FIG. 4 is a pictorial view of the front side of a prize drawing game of chance entry form, bearing a bar code (which can be either a mock bar code or a true, laser-scannable bar code) and a set of indicia in the form of boxes, blanks and spaces for indicating where, in relation to the bar code (or mock bar code), the UPC number is to be entered in writing on the form.

In a preferred embodiment, the entry form contains a display advertisement depicting the particular product which the game sponsor seeks to promote (shown schematically on FIGS. 1 and 3 and illustrated at (1) on FIG. 4). The entry form also contains a written notice setting forth the rules of the prize drawing game of chance (shown schematically on FIGS. 1 and 3 and in phantom at (2) on FIG. 5). The entry form also includes a laser-scannable imprinted bar code (shown at (3) on FIG. 4), which uniquely identifies the product which is the object of the promotion, together with an instruction (not shown) in the rules to the effect that the universal product code (UPC) number of the product depicted on the entry form must be entered on the entry form in handwriting by the entrant in order for the form to be complete and eligible for the prize drawing. Boxes or spaces indicating where the numbers are to be entered, as shown in FIG. 4, at (4), are provided. The boxes or spaces are so placed as to imitate the location of the UPC number as it appears on the label of the product which is the object of the promotion—at the margin of the bar code—so that the entrant may more easily find and recognize the UPC number on the product label and may more easily enter it correctly on the entry form. The entry of this numerical information in handwriting serves to deter the counterfeiting of prize drawing entry forms. Because the UPC number of the product is not easily ascertainable by the entrant except by examining the label of the product which bears that number, the requirement that this numerical information be entered also serves to create a likelihood that the entrant will actually have sought out, viewed, and handled (if not actually purchased) the product which the game seeks to promote. Hence, the handwritten-UPC requirement not only gives entrants an incentive to seek out the product sought to be promoted, but selects for contest entrants who have taken the initiative to seek out the product. Although not every such person necessarily is, or necessarily will become, an actual purchaser of the product, the handwritten-UPC-number requirement does tend to select for likely purchasers as well as to promote, actively, entrants' behavior which involves seeking out, handling, and viewing the product.

Alternatively, the rules could specify that the UPC number may be affixed to the entry form by means other than handwriting it—as, for example, by clipping the UPC bar code and numeric code from a product package and attaching it to the entry form.

The rules could specify that only entry forms received by a specified date may be eligible for a particular drawing. The rules might also include requirements that entrants be residents of the state in which the prize drawing is conducted and/or that entrants be over a threshold age. For example, eligibility for a prize drawing in California might be limited to California residents over eighteen years of age. The rules may also define the frequencies and numbers of prize drawings and the values of the prizes. For example, the rules may provide that a certain number of winners will be chosen per month, and that the prize shall be a check for $10,000 or a certificate redeemable for $10,000 worth of goods or services. The prize amount may vary between different categories of winners. Wide variation in the content of the rules is of course possible without departing from the spirit and scope of the invention.

Where the game of chance entry forms are to be distributed through ATM machines or cash registers, media suitable to bear printed indicia, such as rolls or strips of paper, or paper cards, or fan-folded strips of paper, or other materials as are known in the art, are supplied to the ATM machine or cash register. Prize drawing entry forms are preprinted on each card or preprinted at intervals along the rolls or strips. The roll or strip is also adapted to receive the conventional data generated during the transactions for which the machine is designed—i.e., banking transactions in the case of the ATM machine, and purchase transactions in the case of the cash register. The preprinted entry forms may be spaced to occur repetitively at six inch intervals along a strip, roll or fan-folded strip of material suitable to bear printed indicia; but longer and shorter intervals are of course practical as well. Where the machine generates and ejects a relatively short strip, as an ATM machine typically will do, there will typically be one entry form per ATM receipt, as shown in FIG. 2. Where a longer strip is generated and ejected (as in the course of purchasing a long list of groceries, for example), the strip that is ejected may include more than one game entry form.

The entry forms need not be preprinted—that is, they need not have been printed on the materials suitable to bear printing before those materials are inserted into the ATM machines or cash registers. Instead, for example, the entry forms may be generated within the ATM machines or cash registers themselves through the use of conventional printing means located therein.

The ATM receipt or other type of entry form may bear the address of a processing facility and instructions to mail the completed entry form to that address; or it may bear instructions as to where and how else to deposit the completed form for collection and inclusion in the pool for the drawing.

It is feasible to conduct several product-promotional prize drawing games of chance simultaneously, each promoting a different product, and to administer the games simultaneously through a single, centralized processing facility. Such central, simultaneous administration is particularly facilitated when the preferred embodiment, which utilizes entry forms imprinted with a laser-scannable bar code which uniquely identifies a product, is used. The processing of such forms by the game operator may be easily, conveniently, and speedily done with the aid of computerized laser-scanning equipment which reads the bar code, thereby identifies the product to which a particular entry form pertains, and sorts that entry form according to product. The sorting may be fully automated or may be done by a human sorter, with or without assistance from the laser-scanning equipment in quickly identifying the product to which each entry form pertains. Whether the scanning is done in a fully automated manner or by a human sorter with or without automated assistance, the ultimate result of the sorting is that entry forms are separated into batches, each separate batch containing the entry forms which were returned with respect to a particular product. Each separate batch then constitutes the pool from which the prize-winning entry forms are randomly drawn. After a set number of entry forms have accumulated or a set time period has passed, and after the forms have been appropriately sorted, a random sample of entry forms is selected by chance. After the entry forms are selected, they may be inspected to assure that the UPC number is correctly affixed. If it is not, the entry form may be disqualified and another form drawn in its place.

Each entrant whose entry form is selected and not disqualified is then notified that he or she has won a prize. Each prize winner receives a prize, which may be anything of value but which, in a preferred embodiment of the invention, is a check of a certain value or a certificate (either of which may be non-transferrable) that is redeemable and sets forth specified amounts or quantities of goods or services, of participating brands, that the winner may redeem by presenting the certificate.

The funding of prizes need not be supported by revenues generated through purchases by those who have turned in entry forms. The prizes may be funded, for example, from the general revenues of participating retail establishments, or by contributions from companies whose brands of goods or services are being promoted by the game.

In another embodiment, as noted above, a mock bar code—i.e., a set of markings that simulates the appearance of a true, laser-scannable bar code—is used in place of the latter, but the entry form does include the instruction that the numeric UPC code must be entered in handwriting on the entry form. Although the mock bar code does not actually encrypt a code and cannot actually be read by a laser scanner or other means, the mock bar code does afford the game entrant a visual aid which facilitates finding and recognizing the bar code, and the associated UPC number, on the product label, and facilitates the accurate filling-in of the numeric UPC code on the game entry form. Sorting, when the mock-bar-code embodiment is used, cannot be done with the aid of a laser scanner. Entry forms can, however, be sorted manually using the handwritten numeric UPC. All entry forms bearing a given numeric code are sorted into a batch consisting of the entry forms collected for the prize drawing game which corresponds to the product which corresponds to that UPC. Forms which bear the incorrect UPC number for a product (even if they bear an image of the correct product) are rejected as ineligible for the prize drawing corresponding to that product. Once the batches of entry forms are assembled, one or more prize-winning forms are selected by random drawing.

In a variant of the selection procedure, usable if the entry form bears a depiction of the product being promoted, entry forms are sorted by product depiction, the drawing is held, and only thereafter are the UPC numbers inspected for accuracy. Any form bearing an incorrect UPC number may be disqualified at that point, and another entry form drawn in its place.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for the playing, by an operator and a plurality of entrants, of a product-promotional prize drawing game of chance, utilizing written entry forms which bear thereon a mock bar code, and a depiction of the product which is the object of the promotion, and written indicia indicating a place thereon for the filling-in by an entrant of the UPC number which identifies said product, which method comprises the following steps:

(a) procurement by each entrant of at least one of said written entry forms from at least one of a set of alternative sources which are made available to entrants, such set comprising at least two of the following alternative sources: (1) A newspaper which contains the written entry form as a clippable coupon; (2) a flyer which contains the written entry form as a coupon; (3) a mailer which contains the written entry form as a coupon; (4) a poster which bears the written entry form as a coupon; (5) a coupon dispenser which bears the written entry form as a dispensable coupon; (6) a card holder which bears the written entry form as a dispensable card; (7) an automatic teller machine (ATM) which dispenses the written entry form on a medium which also contains a written transaction receipt; (8) an ATM which dispenses the written entry form separately from any transaction receipt; (9) a cash register which dispenses the written entry form on a medium which also contains a written transaction receipt; (10) a cash register which dispenses the written entry form separately from any transaction receipt; (11) a person who dispenses the written entry form; or (12) a shopping bag which bears the entry form as a coupon;

(b) filling-in by each entrant of self-identifying information upon one or more written entry forms;

(c) ascertainment by each entrant of the Universal Product Code (UPC) number applicable to the product depicted on the written entry form;

(d) affixation by each entrant of a UPC number to one or more written entry forms, at the place on each such written entry form which is thereon indicated therefor;

(e) deposit by each entrant of one or more written entry forms, in filled-in condition, in one or more depositories designated therefor by the operator;

(f) collection of such entry forms by the operator;

(g) sorting of such entry forms by the operator to identify those which bear the correct UPC number for the product which is the object of the promotion;

(h) random selection by the operator, from among the entry forms which bear such correct UPC number, of one or more forms; and (i) notification, by the operator, of each entrant whose name appears on such a randomly-selected entry form that bears the correct UPC number for the product which is the object of the promotion, that such entrant has been chosen to be awarded a prize.

2. A method for the playing, by an operator and a plurality of entrants, of a product-promotional prize drawing game of chance, utilizing written entry forms which bear thereon a mock bar code, and a depiction of the product which is the object of the promotion, and written indicia indicating a place thereon for the filling-in by an entrant of the UPC number which identifies said product, which method comprises the following steps:

(a) procurement by each entrant of at least one of said written entry forms from at least one of a set of alternative sources which are made available to entrants, such set comprising at least two of the following alternative sources: (1) A newspaper which contains the written entry form as a clippable coupon; (2) a flyer which contains the written entry form as a coupon; (3) a mailer which contains the written entry form as a coupon; (4) a poster which bears the written entry form as a coupon; (5) a coupon dispenser which bears the written entry form as a dispensable coupon; (6) a card holder which bears the written entry form as a dispensable card; (7) an automatic teller machine (ATM) which dispenses the written entry form on a medium which also contains a written transaction receipt; (8) an ATM which dispenses the written entry form separately from any transaction receipt; (9) a cash register which dispenses the written entry form on a medium which also contains a written transaction receipt; (10) a cash register which dispenses the written entry form separately from any transaction receipt; (11) a person who dispenses the written entry form; or (12) a shopping bag which bears the entry form as a coupon;

(b) filling-in by each entrant of self-identifying information upon one or more written entry forms;

(c) ascertainment by each entrant of the Universal Product Code (UPC) number applicable to the product depicted on the written entry form;

(d) affixation by each entrant of a UPC number to one or more written entry forms, at the place on each such written entry form which is thereon indicated therefor;

(e) deposit by each entrant of one or more written entry forms, in filled-in condition, in one or more depositories designated therefor by the operator;

(f) collection of such entry forms by the operator;

(g) random selection by the operator, from among the entry forms collected, of one or more entry forms;

(h) checking by the operator to ascertain that each such randomly-selected entry form bears the correct UPC number for the product which is the object of the promotion; and (i) notification, by the operator, of each entrant whose name appears on such a randomly-selected entry form that bears the correct UPC number for the product which is the object of the promotion, that such entrant has been chosen to be awarded a prize.

3. A method of operating a game, comprising the steps of:

printing a mock bar code and an image of a product on an entry form, with the product having a real UPC and UPC numbers;

providing the entry form to a game entrant;

entering information on the entry form identifying the entrant;

determining the real UPC numbers of the product appearing in the image on the entry form, by locating and examining the product;

entering numbers corresponding to the real UPC on the entry form;

collecting the entry form from the entrant; and determining whether the UPC number has been correctly entered on the entry form.

4. The method of claim 3 further comprising the step of using the mock bar code as a visual aid which facilitates determining the real UPC numbers of the product appearing in the image.

* * * * *